United States Patent [19]

Wilkerson

[11] 4,396,190

[45] Aug. 2, 1983

[54] WEIGHTED DEVICE AND METHOD OF MAKING SAME

[76] Inventor: C. William Wilkerson, 7709 Audubon Dr., Raleigh, N.C. 27609

[21] Appl. No.: 253,775

[22] Filed: Apr. 13, 1981

[51] Int. Cl.[3] ..... A63B 21/12

[52] U.S. Cl. ..... 272/119; 273/DIG. 5; 273/DIG. 30

[58] Field of Search ..... 272/119, 143, 67, 96; 2/162, 2.1 R, 2.1 A; 273/DIG. 30, DIG. 5, DIG. 19; 156/301

[56] References Cited

U.S. PATENT DOCUMENTS 3,384,372 5/1968 Dickens ..... 273/DIG. 5
3,525,141 8/1970 Smith ..... 272/96 X
3,749,400 7/1973 Stoffel ..... 273/DIG. 5 X
4,239,211 12/1980 Wilkerson ..... 272/119

*Primary Examiner*—Richard C. Pinkham
*Assistant Examiner*—William R. Browne
*Attorney, Agent, or Firm*—Mills and Coats

[57] ABSTRACT

A weighted device which is suitable for wearing about either the appendages or the body of the user thereof to build strength and for similar purposes. The present device is preferably constructed of a plurality of elongated weights interconnected in spaced relation to each other and enclosed within a fabric sleeve and encapsulated in a closed cell material with a soft vinyl coating which gives flexibility without bulging and eliminates bunching and shifting of the weights during violent maneuvers such as rapid movement exercises.

18 Claims, 2 Drawing Figures

WEIGHTED DEVICE AND METHOD OF MAKING SAME

FIELD OF INVENTION

This invention relates to exercise devices and more particularly to weighted devices to be worn about either the trunk and/or appendages of the body.

BACKGROUND OF INVENTION

In the past various types of exercise devices have been developed to build strength in the muscles of the body and to tone such muscles. In addition to such common methods as lifting weights and working out with tethered and spring biased exercise devices, weighted belts and head gear as well as ankle and wrist encircling devices have been devised. It is well recognized that the wearing of weights on the ankles and wrists as well as on the head and around the waist of the user will place a strain on the muscles thereby developing and toning the same. By far the preferred method of weighting these various and often complex devices have been through the use of lead shot which are relatively heavy in weight, will readily conform to the contours of the body and are relatively easy to incorporate into the finished manufactured product.

The big drawback in the use of lead shot for weighted exercise devices is that such shot tends to shift or bunch up thus becoming uncomfortable to the user and creating an unbalanced situation which, particularly when used in conjunction with athletic practice, can be not only annoying but on some occasions dangerous during violent maneuvers. Attempts to overcome this objectionable attribute of lead shot for weighted exercise devices have been compartmentalizing such shot. This has only met with limited success in that a plurality of small bunched up weights are encountered rather than one large massed weight. The bunching is still very uncomfortable and the problem of throwing the user off balance by the shifting of the shot has not been overcome.

In an attempt to overcome the shifting problem of shot weight, a plurality of pocket like openings have been provided with cylindrical shaped, slug-like weights being insertable therein. This to some extent eliminates the shifting problem of shot although the weights still tend to bunch up one adjacent the other during violent maneuvers and the uncomfortableness of wearing these prior art devices has been a distinct drawback.

None of the prior known devices have been able to overcome the shifting of the weights during use and particularly during violent motions nor has the lumpy construction of such devices been overcome to provide a comfortable and yet efficient weighted exercise device.

BRIEF DESCRIPTION OF INVENTION

After much research and study into the above-mentioned problems, the present invention has been developed to provide a weighted exercise device in the form of a band which can be made in a number of various sizes and which is heavy in weight for its volume, is comfortable to wear, and wherein the weights will not shift even as a result of violent exercise.

The above results are accomplished through the use of a plurality of elongated weights held in spaced relation to each other by a web like material with the limited stretch coefficient enclosed in a fabric sleeve and encapsulated in a closed cell vinyl type material having a density similar to foam rubber. A strap is incorporated in one end of the device of the present invention and is adapted to retainingly cooperate with either a Velcro type material at the other end or other suitable securing means. To the touch, the device is soft and supple, will readily contour to body and appendage contours and can be worn for extended period of time without discomfort or other adverse effects.

In view of the above, it is an object of the present invention to provide a weighted exercise device which can be worn for extended periods of time to tone the muscles of the user thereof without causing discomfort.

Another object of the present invention is to provide an exercise device including a plurality of weights which will not shift or otherwise be deflected during violent exercise of the user thereof.

Another object of the present invention is to provide an exercise device which is smooth to the touch, will not shift during wear and which is readily attachable and detachable.

Another object of the present invention is to provide a weighted device which, although soft and supple to touch, has a relatively high friction coefficient when used juxtaposed to a weighted sleeve for adding additional weight for either exercise, diving or other purposes.

Another object of the present invention is to provide a weighted device of simple and yet durable construction.

Another object of the present invention is to provide a weighted device with a plurality of elongated weights disposed between a web like material of relatively low stretch coefficient enclosed within a fabric sleeve and encapsulated within an envelope of closed cell material having a density approximating that of foam rubber.

Another object of the present invention is to provide a weighted torso and appendage encircling device which completely seals and isolates the weight members contained therein from the external environment.

An object of the present invention is to provide a method of bonding a plurality of elongated weights in spaced relation to each other between two strips of relatively nonelastic, web-like material enclosing the same in a fabric sleeve, encapsulating such in a relatively soft material having a density approximating that of foam rubber, securing a fastening strap juxtaposed to said web and coating the product in a relatively soft, plyable material to provide a soft, flexible, nonweight-shifting exercise device.

Other objects and advantages of the present invention will become apparent and obvious from a study of the following description and the accompanying drawings which are merely illustrative of such invention.

DETAILED DESCRIPTION OF INVENTION

Figure 1:
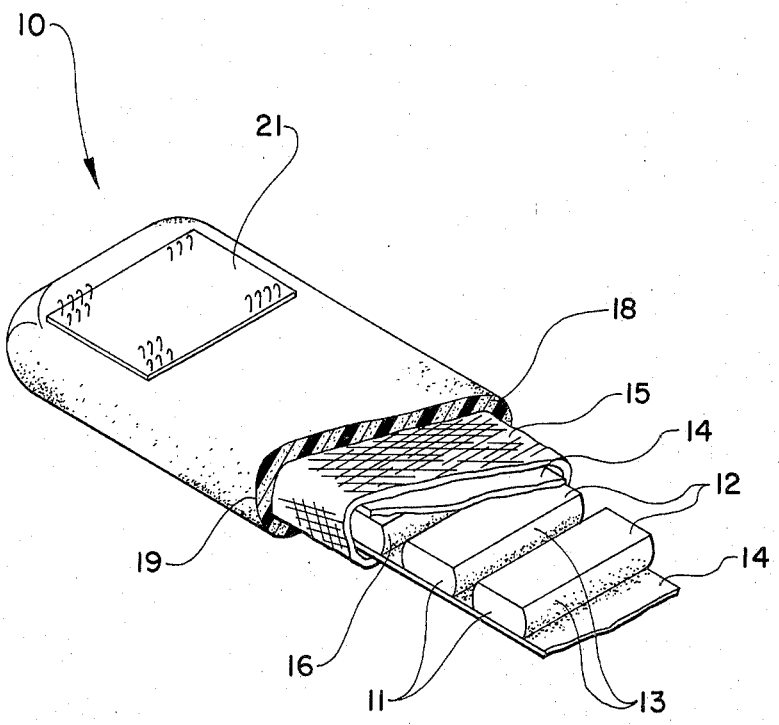
FIG. 1 is a cutaway perspective view of the weighted webs enclosed in the fabric sleeve and capsulated within the enclosed cell material.
Figure 2:
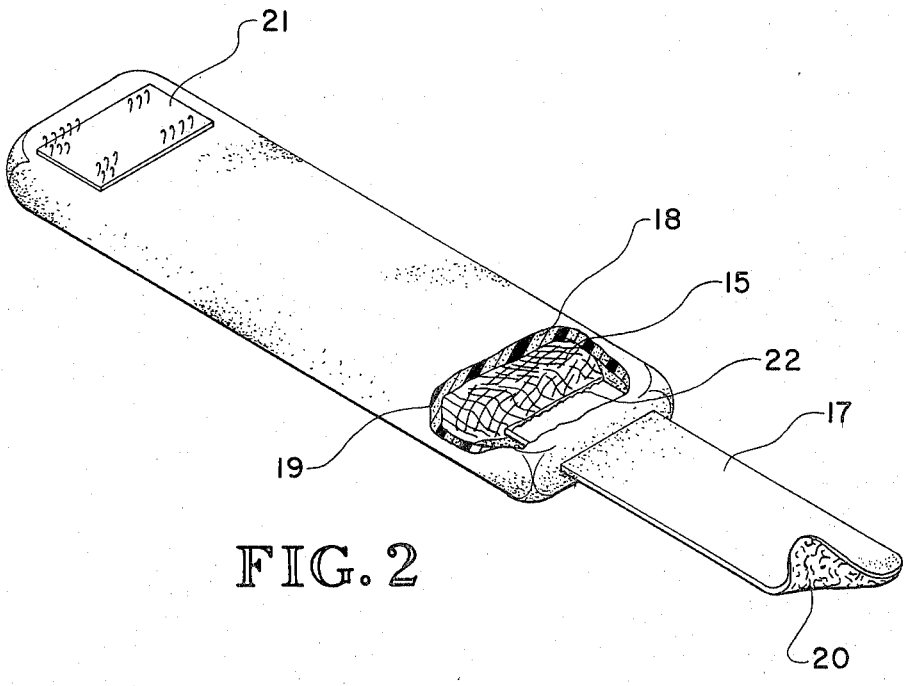
FIG. 2 is a partially cutaway perspective view of the weighted exercise device showing the strap means integrally secured thereto.

With further reference to the drawings, a preferred embodiment of the weighted exercise device of the present invention is indicated generally at 10 and is constructed in four phases. First a plurality of weights 11 are provided which can be cut from stock bar material and are generally elongated with side portions 12 being generally flat and edge portions 13 being rounded or arcuate in cross section. The purpose of this configuration will become more apparent as hereinafter described.

Each of the weights 11 is disposed generally parallel to each other.

A limited stretch webbing material, preferably of the fabric type, is indicated at 14 and is disposed on either side of weights 11 and are bonded to the flat sides 12 of each of such weights. This bonding of the webs 14 juxtaposed to each of the flat sides 12 of weights 11 can be of any suitable means such as impregnation with a glue-like substance. Weights 11 are spaced on the tape on one side and adhered thereto, then a second layer placed on the opposite side of each of the weights to form a weighted web.

Regardless of the manner in which web 14 is adheringly or bondingly secured to weights 11, the finished configuration leaves an air space or pocket 16 between the weights. The purpose of this particular construction is to allow the exercise device of the present invention to bend not only at the pockets parallel to the longitudinal axis of the weights 11, but also to allow twisting to occur about the longitudinal axis of the overall device 10. In other words, the spaced weights and secured webbing provides a weighted web which can be rolled and twisted relative to its overall length.

Once the weighted web has been constructed as described above, the same is enclosed within a fabric sleeve. This sleeve is preferably formed from cylindrical shaped knitted stock with the ends enclosed by stitching, gluing, or any suitable means. Tongue 17 is secured to one end of fabric sleeve 15 by a suitable means such as stitching 22.

Once the above has been accomplished, the entire enclosed weighted web is encapsulated within a relatively soft, close cell like material having a density approximating that of foam rubber. Once the weighted belt has been thus capsulated within the sponge like material 18, the entire exercise device 10, with the exception of a securing tongue or strap 17, is hot dipped in a vinyl material to give a tough and yet soft and plyable skin 19.

The purpose of the fabric sleeve enclosing the weighted web is to protect the closed cell material from the damaging effect of rubbing against such weights during use and yet such sleeve, because of its knitted construction, is stretchable and therefore does not in any way impede the normal flexibility of the device of the present invention.

One side of strap 17 includes a fibrous loop material 20. Fixedly adhered to the skin 19 of the end of the exercise device opposite strap 17 is a material composed of a multiplicity of small resilient hook means 21. When the fibrous loop material 20 and the hook material 21 are placed juxtaposed to each other and pressed together, the hooks 21 become entangled in the fibrous loops 20 to form a relatively secure and yet releasable bond. This bond is relatively easily broken by peeling the layers apart, however, sliding movement between the surfaces is extremely difficult thereby providing in the present case a relatively simple securing means of great strength. Securing products of this general type are sold under the brand name Velcro which is commercially available.

Whenever the weighted exercise device of the present invention is desired to be used, it can simply be wrapped around the appendage of the wearer thereof (whether the leg, ankle, head or the like) and surfaces 20 and 21 securingly pressed together to hold the device in proper position. Because the pocket spaces 16 allow relative movement between the weights 11 and because the curved or arcuate side portions 13 allow smooth contact between adjacent weights, coupled with the fact that the sponge like material 18 and the skin 19 are flexible, pliable and stretchable, a comfortable, contoured fit is accomplished.

Referring more specifically to the process of producing the weighted device of the present invention, a fabric or other suitable web type material 14 is laid on a flat surface. Weights 11 are then distributed in appropriate space relationship to each other on the web and through the use of a suitable adhesive are retainingly secured thereto. A second web 14 is then disposed on the opposite side of the weights and again is adhered thereto. The thus formed weighted web can then be dipped in a suitable glue type substance which form a permanent bond between the webbing and the weights.

The weighted web is then inserted into fabric sleeve 15 which has one end closed by a suitable means to form a pocket like configuration. Next strap or tongue 17 is secured to fabric sleeve 15 by any suitably strong means such as stitching 22. This stitching also closes the end of sleeve 15 to enclose the weighted web within the fabric member. Such fabric enclosed weighted web is then inserted into a preformed sleeve of closed cell vinyl, rubber or neoprene as indicated at 18. The single open end of this sleeve has projecting therethrough strap 17 and once the fabric enclosed weighted web is in proper position within the sleeve, such end can be permanently sealed with a suitable glue type bonding substance.

Once sealed, the entire weighted device is twice or double dipped in a liquid vinyl or neoprene to form the tough, yet soft, supple and plyable skin 19. Finally the patch of hook material 21 is bonded to the exterior of the device so that the same can be releasably secured to the loop material 20 of strap 17.

The final step in production of the weighted device of the present invention is to silk screen the product trade name, pertinent weight information, etc., on the exterior of skin 19.

For extra large weighted devices constructed in accordance with the present invention, rather then inserting the fabric enclosed weighted web in a preformed sleeve of closed cell material, a flat sheet of such material can be laid out and folded over the web with a permanent bond being formed through use of a suitable bonding agent such as the quick drying glue referred to above. The remainder of the device forming process would be completed as described above for the preformed sleeve version.

From the above, it is obvious that the present invention provides a weighted device which has a plurality of uses, whose weights will not shift even during violent exercises, and that is comfortable to the wearer thereof. The present invention also provides a weighted device which can be rolled and twisted and yet at all times provides an evenly distributed, nonshiftable weight balance.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced therein.

What is claimed is:

1. The process of producing a weighted device comprising: bonding a plurality of elongated weight means in spaced relationship to a web means to form a weighted web; enclosing said weighted web within a fabric, sleeve-like member; securing a strap means to one end of said fabric sleeve; and permanently encapsulating said enclosed weighted web within a pliable, closed cell material whereby an improved weighted device is produced.

2. The process of claim 1 wherein said encapsulating closed cell material is exteriorly coated.

3. The process of claim 2 wherein said coating is accomplished by dipping in a liquid material.

4. The process of claim 3 wherein said coating material is a vinyl.

5. The process of claim 3 wherein said coating material is neoprene.

6. The process of claim 1 wherein said fabric sleeve is so constructed as to be flexible and stretchable.

7. The process of claim 6 wherein said fabric sleeve is a knitted fabric.

8. A weighted device comprising: a plurality of elongated weight means; web means bonded to opposite sides of said weight means to secure the same in spaced relation to each other; said web means comprising at least two elongated spaced apart substantially parallel strips engaging the weight means on the opposite sides thereof, a fabric sleeve enclosing the weight means and strips; a pliable, closed cell material encapsulating said fabric enclosed web weights whereby a weighted device is formed; and fastening means secured to the respective ends of said encapsulating weighted device whereby the same can be releasably secured about a portion of the body of the user thereof.

9. The weighted device of claim 8 wherein said elongated weight means are generally flat along the side juxtaposed to said web means.

10. The weighted device of claim 9 wherein the adjacent surfaces to said weights are generally arcuate when viewed in cross section.

11. The weighted device of claim 8 wherein the closed cell material is vinyl.

12. The weighted device of claim 8 wherein the closed cell material is rubber.

13. The weighted device of claim 8 wherein the closed cell material is neoprene.

14. The weighted device of claim 8 wherein the fastening means is a strap-like member using Velcro type hook and fiber material as a releasable attaching means.

15. The weighted device of claim 8 wherein the exterior of the device is vinyl coated.

16. The weighted device of claim 8 wherein the exterior of the device is neoprene coated.

17. The weighted device of claim 8 wherein said weight means is lead.

18. The weighted device of claim 8 wherein said weight means is a barium alloy.

* * * * *